US009616446B2

(12) United States Patent
Hirota et al.

(10) Patent No.: US 9,616,446 B2
(45) Date of Patent: Apr. 11, 2017

(54) APPLICATION APPARATUS FOR APPLYING COHESIVE MATERIAL TO APPLICATION TARGET

(71) Applicants: KABUSHIKI KAISHA YASKAWA DENKI, Fukuoka (JP); MAZDA MOTOR CORPORATION, Hiroshima (JP)

(72) Inventors: Hiroyasu Hirota, Shanghai (CN); Kenichi Takiguchi, Saitama (JP); Masanori Takasaki, Hatsukaichi (JP); Eiichi Kawase, Hiroshima (JP); Nobuhiro Takaba, Aki-gun (JP); Hidekazu Kato, Aki-gun (JP); Naoto Waku, Hiroshima (JP)

(73) Assignees: KABUSHIKI KAISHA YASKAWA DENKI, Fukuoka (JP); MAZDA MOTOR CORPORATION, Hiroshima (JP)

( * ) Notice: Subject to any disclaimer, the term of this patent is extended or adjusted under 35 U.S.C. 154(b) by 0 days.

(21) Appl. No.: 14/386,741

(22) PCT Filed: Mar. 22, 2013

(86) PCT No.: PCT/JP2013/001945
§ 371 (c)(1),
(2) Date: Sep. 19, 2014

(87) PCT Pub. No.: WO2013/140814
PCT Pub. Date: Sep. 26, 2013

(65) Prior Publication Data

US 2015/0047562 A1 Feb. 19, 2015

(30) Foreign Application Priority Data

Mar. 22, 2012 (JP) ..... 2012-065687

(51) Int. Cl.
*B05B 12/04* (2006.01)
*B05B 1/14* (2006.01)
(Continued)

(52) U.S. Cl.
CPC ..... *B05B 12/04* (2013.01); *B05B 1/14* (2013.01); *B05B 1/30* (2013.01); *B05B 9/0406* (2013.01);
(Continued)

(58) Field of Classification Search
None
See application file for complete search history.

(56) References Cited

U.S. PATENT DOCUMENTS 4,530,862 A * 7/1985 Kerzel ..... B05C 11/10 118/669
5,215,253 A * 6/1993 Saidman ..... B05B 7/2486 118/300
(Continued)

FOREIGN PATENT DOCUMENTS

DE 102006021623 A1 11/2007
JP 58-145443 A 8/1983
(Continued)

OTHER PUBLICATIONS

International Search Report; PCT/JP2013/001945; Jun. 11, 2013.

*Primary Examiner* — Binu Thomas
(74) *Attorney, Agent, or Firm* — Studebaker & Brackett PC

(57) ABSTRACT

An application apparatus includes a nozzle device (20) injecting a damping material from a nozzle hole (20*a*) to a vehicle body, an articulated robot (21) moving the nozzle device (20) relative to the vehicle body, a supply section including a supply pump (22), and a supply passage (27), and continuously driving the supply pump (22) to continu-
(Continued)

ously supply the damping material from the supply pump (22) to the supply passage (27) in a substantially uniform amount, a return passage (33) branched from the supply passage (27) and returning the damping material to the supply pump (22), and a gun (32) and a return valve (34) switching a supply destination of the damping material between the nozzle hole (20*a*) and the return passage (33) based on information on applying the damping material to the vehicle body.

11 Claims, 9 Drawing Sheets

(51) Int. Cl.

| | |
|---|---|
| ***B05B 1/30*** | (2006.01) |
| ***B05B 9/04*** | (2006.01) |
| ***B05B 13/04*** | (2006.01) |
| ***B05C 11/00*** | (2006.01) |
| ***B05C 5/02*** | (2006.01) |
| ***B05C 11/04*** | (2006.01) |
| ***B05C 11/10*** | (2006.01) |

(52) U.S. Cl.

CPC ..... *B05B 9/0413* (2013.01); *B05B 9/0423* (2013.01); *B05B 13/0431* (2013.01); *B05C 5/027* (2013.01); *B05C 5/0216* (2013.01); *B05C 5/0279* (2013.01); *B05C 11/044* (2013.01); *B05C 11/1002* (2013.01); *B05C 11/1042* (2013.01); *B05C 11/1047* (2013.01); *Y10S 901/43* (2013.01)

(56) References Cited

U.S. PATENT DOCUMENTS

| | | | | |
|---|---|---|---|---|
| 5,407,132 | A * | 4/1995 | Messerly | B05B 7/32 239/124 |
| 5,683,508 | A * | 11/1997 | Bleiler | B41F 31/08 118/663 |
| 5,911,362 | A * | 6/1999 | Wood | A01M 7/0089 239/1 |
| 2006/0163277 | A1* | 7/2006 | Vidal | B05C 11/10 222/55 |
| 2008/0166490 | A1* | 7/2008 | Hogan | B05C 11/1039 118/300 |
| 2008/0271674 | A1* | 11/2008 | Rademacher | B05C 11/1047 118/707 |
| 2008/0286475 | A1* | 11/2008 | Liu | B05C 5/0258 427/372.2 |
| 2010/0212814 | A1* | 8/2010 | Yamamoto | B05C 11/1042 156/161 |
| 2010/0310778 | A1 | 12/2010 | Shioi et al. | |
| 2011/0052811 | A1* | 3/2011 | McGuffey | B05C 5/025 427/256 |

FOREIGN PATENT DOCUMENTS

| | | | |
|---|---|---|---|
| JP | 61-067861 | U | 5/1986 |
| JP | 03-142995 | A | 6/1991 |
| JP | 04-114754 | A | 4/1992 |
| JP | 10-000398 | A | 1/1998 |
| JP | 10-024259 | A | 1/1998 |
| JP | 2002-164278 | A | 6/2002 |
| JP | 2005-324149 | A | 11/2005 |
| JP | 2007-326037 | A | 12/2007 |
| JP | 2009-183914 | A | 8/2009 |

* cited by examiner

APPLICATION APPARATUS FOR APPLYING COHESIVE MATERIAL TO APPLICATION TARGET

TECHNICAL FIELD

The present disclosure relates to application apparatuses applying cohesive materials to application targets.

BACKGROUND ART

Application apparatuses applying cohesive materials to application targets have been known as conventional art. For example, Patent Document 1 shows an application nozzle provided in the wrist of a robot. The robot operates based on instructions from a controller to apply a damping material as a cohesive material to a vehicle body. The application nozzle includes a nozzle holder, in which a plurality of needle nozzles supplied with the damping material are arranged in parallel. The needle nozzles are connected to a damping material pump, which pumps the damping material via supply solenoid valves. The supply solenoid valves operate based on instructions from the controller to open and close the passages of the damping material. Start and stop of the supply of the damping material to the needle nozzles are independently controlled by the operations of the supply solenoid valves.

CITATION LIST

Patent Document

PATENT DOCUMENT 1: Japanese Unexamined Patent Publication No. H10-24259

SUMMARY OF THE INVENTION

Technical Problem

In Patent Document 1, however, the damping material is supplied from the damping material pump to the needle nozzles via the supply solenoid valves as described above. That is, the damping material pump operates in conjunction with the operation of the supply solenoid valves. At the start of injecting the damping material from the needle nozzles, the operation of the damping material pump causes response delays in supplying the damping material to the needle nozzles, thereby causing displacement of the position applied with the damping material. Such unstable application of the damping material is problematic.

The present invention is made in view of the problem. It is an objective of the present invention to stably apply a damping material.

Solution to the Problem

To achieve the objective, the present invention provides an application apparatus applying a cohesive material to an application target, and the following solution.

Specifically, the apparatus according to a first aspect of the invention includes a nozzle device configured to inject the cohesive material from a nozzle to the application target; a moving section configured to move the nozzle device relative to the application target; a supply section including a supply pump for sending the cohesive material to the nozzle and a supply passage for supplying the cohesive material from the supply pump to the nozzle, and configured to continuously drive the supply pump to continuously supply the cohesive material from the supply pump to the supply passage in a substantially uniform amount; a return passage branched from the supply passage and configured to return the cohesive material to the supply pump; and a switch section configured to switch a supply destination of the cohesive material between the nozzle and the return passage based on information on applying the cohesive material to the application target.

With this feature, the supply pump is continuously driven, thereby continuously supplying the cohesive material from the supply pump to the supply passage in the substantially uniform amount. The switch section switches the supply destination of the cohesive material between the nozzle and the return passage based on the information on applying the cohesive material to the application target. As such, since the supply pump is continuously driven, as compared to the case where the supply pump is intermittently driven, response delays are reduced in supplying the cohesive material to the nozzle at the start of injecting the cohesive material from the nozzle. The cohesive material is injected from the nozzle with good responsiveness. Therefore, the cohesive material is stably injected.

According to a second aspect of the invention, in the first aspect of the invention, the switch section includes a first opening-closing valve provided downstream of a junction between the supply passage and the return passage, and opening and closing the supply passage, and a second opening-closing valve provided in the return passage, and opening and closing the return passage. The switch section switches the supply destination of the cohesive material between the nozzle and the return passage by opening and closing the first and second opening-closing valves.

With this feature, the first opening-closing valve opening and closing the supply passage is provided downstream of the junction between the supply passage and the return passage. The second opening-closing valve opening and closing the return passage is provided in the return passage. These first and second opening-closing valves are opened and closed to switch the supply destination of the cohesive material between the nozzle and the return passage. As a result, the supply destination of the cohesive material is switched between the nozzle and the return passage with the simple structure.

In a third aspect of the invention, the apparatus according to the second aspect of the invention further includes a pressure control section provided downstream of the second opening-closing valve in the return passage, and configured to control pressure in the supply passage.

With this feature, the pressure control section controlling the pressure in the supply passage is provided downstream of the second opening-closing valve in the return passage. Thus, the pressure in the supply passage is controlled to be predetermined pressure.

According to a fourth aspect of the invention, in the second or third aspect of the invention, the first opening-closing valve is provided near the nozzle in the supply passage.

If the first opening-closing valve is far from the nozzle in the supply passage, the flow of the cohesive material between the first opening-closing valve and the nozzle in the supply passage does not stop immediately after closing the first opening-closing valve. The cohesive material may spray out of the nozzle at the end of the injection.

According to the present invention, the first opening-closing valve is provided near the nozzle in the supply passage, thereby minimizing the amount of the cohesive material between the first opening-closing valve and the nozzle in the supply passage. This prevents the cohesive material from spraying out of the nozzle at the end of the injection. Therefore, the cohesive material is applied more stably.

In a fifth aspect of the invention, the apparatus according to any one of the first to fourth aspects of the invention further includes a return pump provided in the return passage, including a storage storing the cohesive material having flowed through the return passage, and configured to send the cohesive material stored in the storage to the supply pump after the cohesive material is applied to the application target.

With this feature, the return pump including the storage storing the cohesive material having flowed through the return passage is provided in the return passage, thereby reducing changes in the characteristics (e.g., curing) of the cohesive material caused by contact with the air. After the end of applying the cohesive material to the application target, the return pump sends the cohesive material stored in the storage to the supply pump. As a result, the cohesive material stably refills the supply pump.

In a sixth aspect of the invention, the apparatus according to any one of the first to fifth aspects of the invention further includes a temperature controller configured to control a temperature of the cohesive material such that the cohesive material has a substantially constant viscosity.

With this feature, the temperature controller controlling the temperature of the cohesive material such that the cohesive material has the substantially constant viscosity is provided. As a result, the viscosity of the cohesive material is controlled to be substantially constant.

According to a seventh aspect of the invention, in any one of the first to sixth aspects of the invention, the nozzle includes a single nozzle or a plurality of nozzles. The nozzle device includes a plurality of nozzle sections each including the single nozzle or the plurality of nozzles. The cohesive material injected from each of the nozzle sections forms an application region with a predetermined width on the application target. The supply pump is provided for each of the nozzle sections to send the cohesive material to a corresponding one of the nozzle sections. The supply passage is provided for each of the nozzle sections to supply the cohesive material from a corresponding one of the supply pumps to a corresponding one of the nozzle sections. The return passage is branched from each of the supply passages to return the cohesive material to the supply pumps.

With this feature, the supply pumps are continuously driven to continuously supply the cohesive material from the supply pumps to the supply passages in the substantially uniform amount. Each switch section switches the supply destination of the cohesive material between the nozzle and the return passage based on the information on applying the cohesive material to the application target. Therefore, similar to the first aspect of the invention, the cohesive material is stably injected.

According to an eighth aspect of the invention, in the seventh aspect of the invention, the nozzle sections are arranged in a line in a predetermined direction.

With this feature, a most preferable embodiment is provided.

According to a ninth aspect of the invention, the seventh or eighth aspect of the invention, the supply pumps are cylinder pumps driven by a same single drive section.

With this feature, the supply pumps are the cylinder pumps driven by the same single drive section. As compared to the case where the supply pumps are driven by different drive sections, the cohesive material is stably continuously supplied from the supply pumps to the supply passages in the substantially uniform amount.

According to a tenth aspect of the invention, in any one of the seventh to ninth aspects of the invention, the switch section includes an injection start instruction timer provided for each of the nozzle sections, and setting an injection start instruction time of outputting an injection start instruction to switch the supply destination of the cohesive material to the nozzle, and an injection end instruction timer provided for each of the nozzle sections, and setting an injection end instruction time of outputting an injection end instruction to switch the supply destination of the cohesive material to the return passage. The switch section switches the supply destination of the cohesive material between the nozzle and the return passage based on the injection start instruction time and the injection end instruction time set by the injection start instruction timer and the injection end instruction timer.

With this feature, the injection start instruction timer setting the injection start instruction time of outputting the injection start instruction to switch the supply destination of the cohesive material to the nozzle, and the injection end instruction timer setting the injection end instruction time of outputting the injection end instruction to switch the supply destination of the cohesive material to the return passage are provided for each of the nozzle sections. Therefore, each nozzle section independently injects the cohesive material from the nozzles.

According to an eleventh aspect of the invention, in any one of the first to tenth aspects of the invention, the switch section includes a plurality of injection start instruction timers each of which sets an injection start instruction time of outputting an injection start instruction to switch the supply destination of the cohesive material to the nozzle, and a plurality of injection end instruction timers each of which sets an injection end instruction time of outputting an injection end instruction to switch the supply destination of the cohesive material to the return passage. The switch section switches the supply destination of the cohesive material between the nozzle and the return passage based on the injection start instruction time and the injection end instruction time set by each of the injection start instruction timers and the injection end instruction timers. When one of the injection start instruction timers is in use to output a corresponding one of the injection start instructions, the switch section allows another one of the injection start instruction timers to set one of the injection start instruction times corresponding to next one of the injection start instructions. When one of the injection end instruction timers is in use to output a corresponding one of the injection end instructions, the switch section allows another one of the injection end instruction timers to set one of the injection end instruction times corresponding to next one of the injection end instructions.

With this feature, when one of the injection start instruction timers is in use to output the corresponding one of the injection start instructions, the another one of the injection start instruction timers sets the injection start instruction time corresponding to the next injection start instruction. When one of the injection end instruction timers is in use to output the corresponding one of the injection end instructions, the another one of the injection end instruction timers sets the injection end instruction time corresponding to the next injection end instruction. Thus, failures in outputting the next injection start instruction and the next injection end instruction are reduced. As a result, the cohesive material is applied more stably.

According to a twelfth aspect of the invention, in any one of the first to eleventh aspects of the invention, the moving section is an articulated robot. Movement of joints of the articulated robot moves the nozzle device relative to the application target.

With this feature, the moving section is the articulated robot. The movement of the joints reliably moves the nozzle device relative to the application target.

Advantages of the Invention

According to the present invention, the supply pump is continuously driven. As compared to the case where the supply pump is intermittently driven, response delays are reduced in supplying the cohesive material to the nozzle at the start of injecting the cohesive material from the nozzle. The cohesive material is injected from the nozzle with good responsiveness. As a result, the cohesive material is stably injected.

BRIEF DESCRIPTION OF THE DRAWINGS

FIG. 4(*a*) is a top view. FIG. 4(*b*) is a front view. FIG. 4(*c*) is a bottom view. FIG. 4(*d*) is a cross-sectional view taken along the line IVd-IVd of FIG. 4(*a*).

FIG. 6(*a*) is a front view. FIG. 6(*b*) is a side view.

DESCRIPTION OF EMBODIMENTS

An embodiment of the present invention will be described hereinafter with reference to the drawings.

Figure 1:
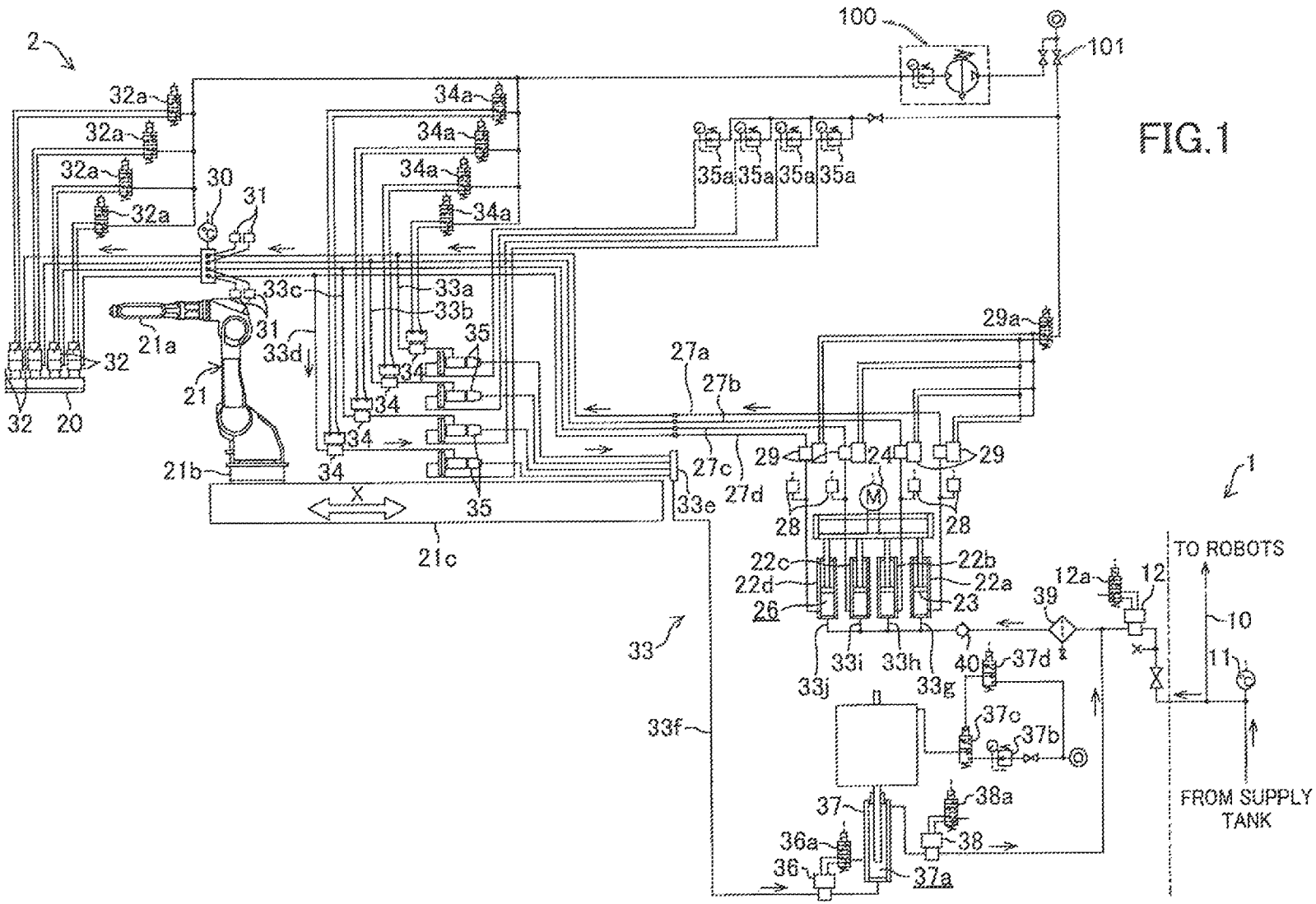
FIG. 1 is a system chart illustrating the structure of an application apparatus according to an embodiment of the present invention.
Figure 2:
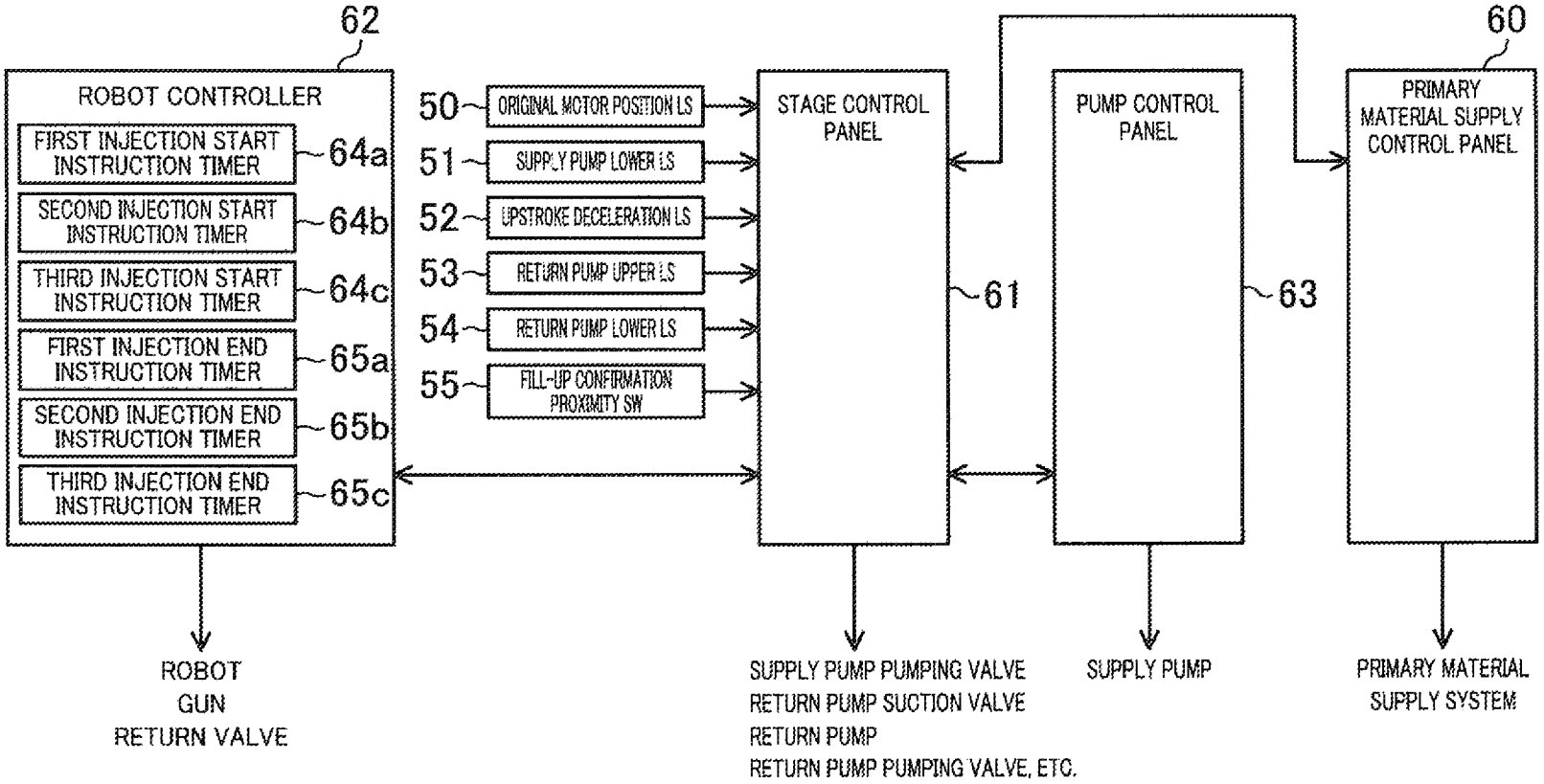
FIG. 2 is a block diagram illustrating a control system of the application apparatus.
Figure 3:
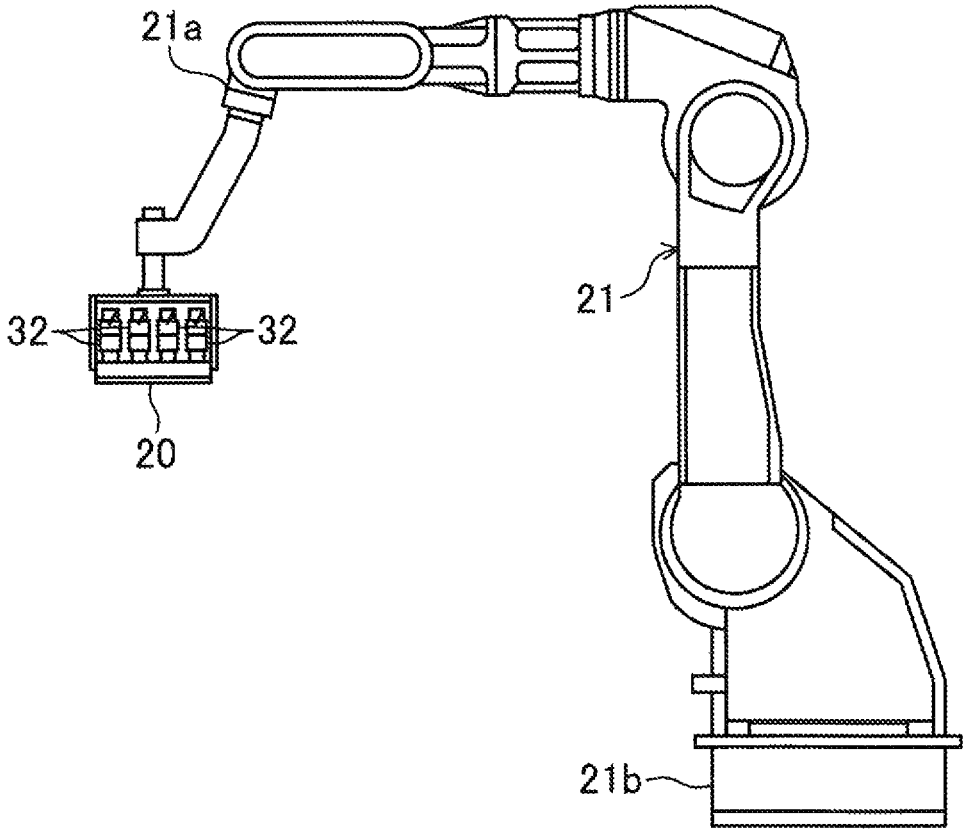
FIG. 3 is a front view illustrating that a nozzle device is attached to the wrist of an articulated robot.
Figure 4A:
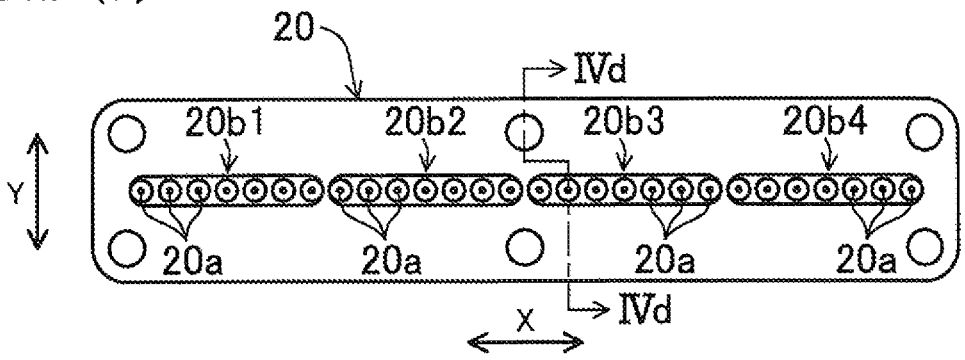
FIG. 4 illustrate the nozzle device.
Figure 4B:
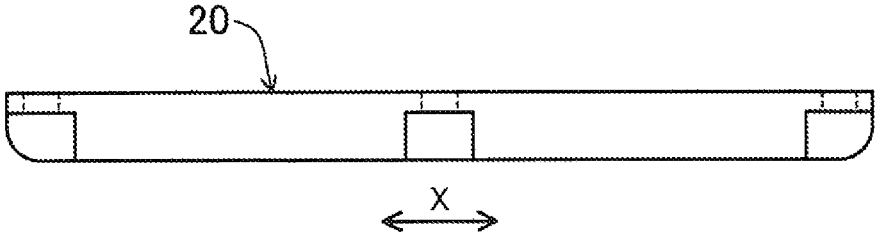
Figure 4C:
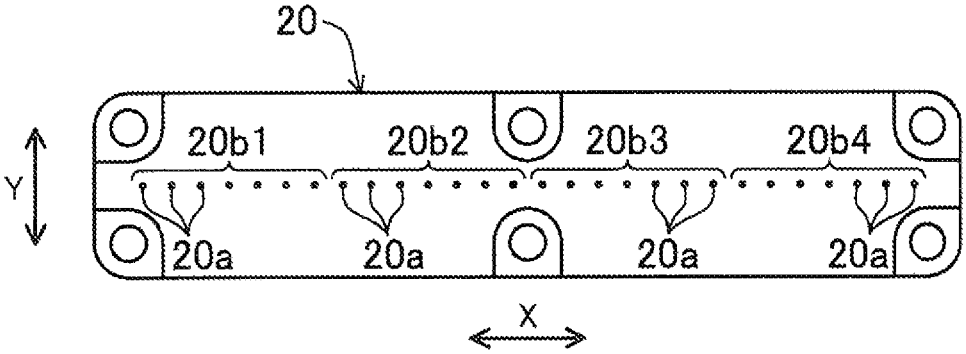
Figure 4D:
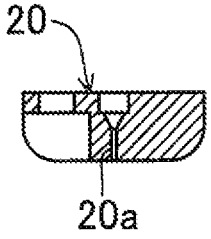
Figure 5:
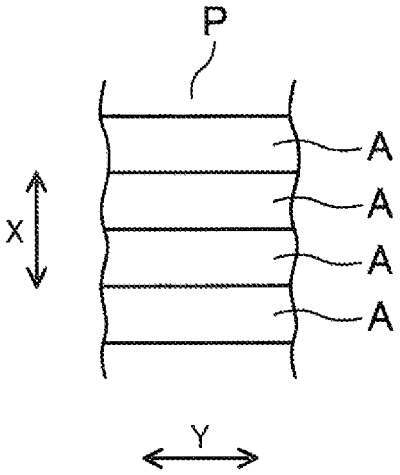
FIG. 5 is a schematic top view illustrating application regions of a damping material on a floor panel.
Figure 6B:
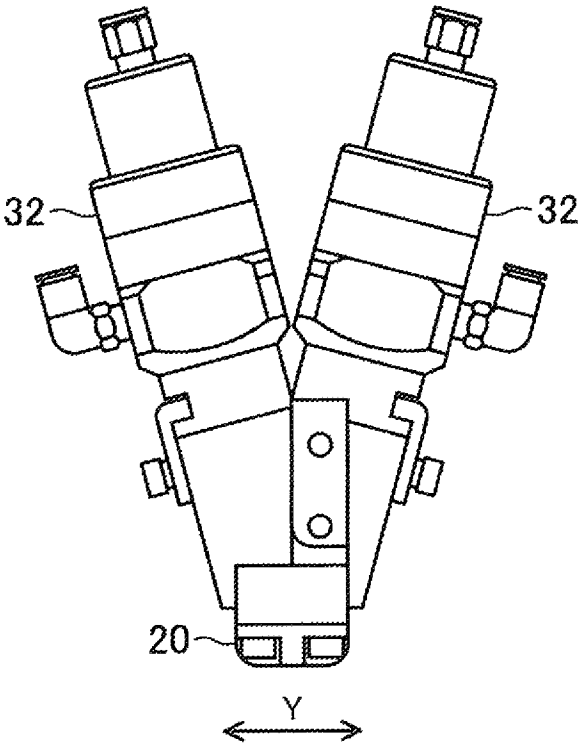
FIG. 6 illustrate guns.
Figure 6A:
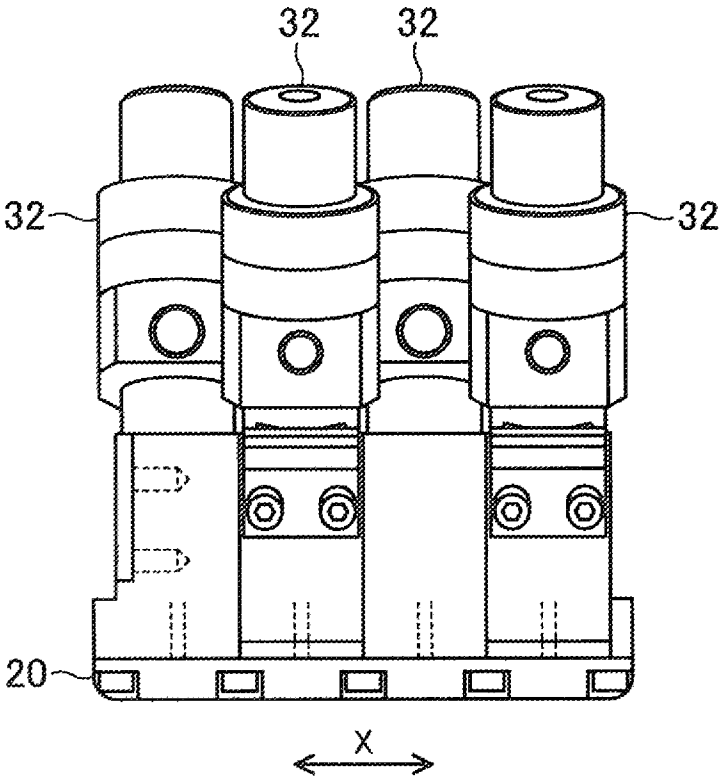

FIG. 1 is a system chart illustrating the structure of an application apparatus according to an embodiment of the present invention. FIG. 2 is a block diagram illustrating a control system of the application apparatus. FIG. 3 is a front view illustrating that a nozzle device is attached to the wrist of an articulated robot. FIG. 4 illustrate the nozzle device. FIG. 4(*a*) is a top view. FIG. 4(*b*) is a front view. FIG. 4(*c*) is a bottom view. FIG. 4(*d*) is a cross-sectional view taken along the line IVd-IVd of FIG. 4(*a*). FIG. 5 is a schematic top view illustrating application regions of a damping material on a floor panel. FIG. 6 illustrate guns. FIG. 6(*a*) is a front view. FIG. 6(*b*) is a side view.

For example, the application apparatus automatically applies the damping material (i.e., a cohesive material), which reduces vibrations, to a floor panel P of a vehicle body (i.e., an application target, see, e.g., FIG. 5). As shown in FIGS. 1 and 2, the application apparatus includes a primary material supply system 1, a secondary material supply system 2, an original motor position limit switch 50 (limit switches are hereinafter simply referred to as LSs), a supply pump lower LS 51, an upstroke deceleration LS 52, a return pump upper LS 53, a return pump lower LS 54, a fill-up confirmation proximity switch 55 (the fill-up confirmation proximity switch is hereinafter simply referred to as a fill-up confirmation proximity SW), a primary material supply control panel 60, a stage control panel 61, a robot controller (switch section) 62, and a pump control panel 63. The damping material contains resin as a main component. The resin is emulsion resin such as SBR vinyl acetate, asphalt, and acrylic. While in this embodiment, a plurality of (e.g., six) secondary material supply systems 2 are provided, FIG. 1 shows only one for simplification.

The primary material supply system 1 includes a supply tank (not shown) containing the damping material, and a supply pipe 10 connected to the supply tank. The damping material is supplied to storages 26 of supply pumps 22, which will be described later, in the secondary material supply system 2 from the tank via the supply pipe 10. The supply pipe 10 heats (e.g., controls the temperature to be 30° C.) the damping material flowing through the supply pipe 10 at a cold time so that the damping material has a substantially constant viscosity. The supply pipe 10 is provided with a temperature sensor 11 detecting the temperature of the flowing damping material. At the downstream of the temperature sensor 11, the supply pipe 10 is provided with a primary suction valve 12 opening and closing the pipe. This primary suction valve 12 is a piston valve controlled by a solenoid valve 12*a*. The primary suction valve 12 is part of the secondary material supply system 2, and driven and controlled by the stage control panel 61.

The secondary material supply system 2 includes a nozzle device 20, an articulated robot (i.e., a moving section) 21, the supply pumps (i.e., supply sections) 22, supply passages 27, and return passages 33.

As shown in FIGS. 3 and 4, the nozzle device 20 is like a plate attached to a wrist 21*a* of the articulated robot 21. In the nozzle device 20, four nozzle groups (nozzle sections) 20*b* are arranged in a line in a predetermined direction (hereinafter referred to as an X axis direction), each of which has seven circular nozzle holes 20*a* extending in the thickness direction and arranged in a line in the X axis direction. In this embodiment, the nozzle groups 20*b* are referred to as first to fourth nozzle groups 20*b*1-20*b*4 from the left of FIG. 4 (*a*).

In applying the damping material to the floor panel P, the articulated robot 21 allows scanning movement of the nozzle device 20 relative to the surface of the floor panel P in the Y-axis direction substantially orthogonal to the X axis direction, which is the alignment direction of the nozzle groups 20*b*, with the nozzle device 20 facing downward. The nozzle holes 20*a* inject the damping material when the nozzle device 20 moves in the Y-axis direction. As shown in FIG. 5, the damping material injected from the nozzle groups 20*b* forms application regions A with a predetermined width in the X axis direction of the surface of the floor panel P. That is, the damping material injected from the nozzle holes 20*a* of each nozzle group 20*b* forms one of the application regions A. The damping material injected from the nozzle groups 20*b* is applied to the floor panel P with no space therebetween. The damping material applied to the floor panel P has a substantially uniform thickness, since the nozzle holes 20*a* are in the circular shape as described above. On the other hand, if each nozzle hole is formed like a slit extending in the X axis direction, the thickness is greater at the ends than at the center in the Y-axis direction. The nozzle device 20 reciprocates in the Y-axis direction in applying a thick damping material. This reciprocation overlappingly applies the damping material. In FIG. 1, the nozzle device 20 is not attached to the wrist 21*a* of the articulated robot 21 for simplification.

As shown in FIGS. 1 and 3, the articulated robot 21 moves the joints to freely move the nozzle device 20 within the operational range. A traveling shaft 21*c* for moving a base 21*b* is provided under the articulated robot 21. This traveling shaft 21*c* is disposed in parallel to the X axis direction. This allows the articulated robot 21 to reciprocate in the X axis direction. In every scanning movement of the nozzle device 20 in the Y-axis direction, the articulated robot 21 moves the nozzle device 20 relative to the surface of the floor panel P in the X axis direction.

The supply pumps 22 send the damping material to the nozzle groups 20*b*. Each nozzle group 20*b* includes four supply pumps 22. In this embodiment, the supply pumps 22 are referred to as first to fourth supply pumps 22*a*-22*d* from the right of FIG. 1. The supply pumps 22 are cylinder pumps having pistons 23 driven by a same single motor (i.e., a drive section) 24 at the same time. Each supply pump 22 includes one of the storages 26 storing the damping material. In applying the damping material to the floor panel P, the motor 24 allows the pistons 23 to continuously descend at a substantially constant speed in the respective supply pumps 22, thereby continuously supplying the damping material from the storages 26 of the supply pumps 22 to the supply passages 27 in a substantially uniform amount. In the upstroke of the pistons 23 of the supply pumps 22, when the motor 24 is close to the original position (initial position), the motor 24 is decelerated.

The supply passages 27 are hoses for supplying the damping material from the storages 26 of the supply pumps 22 to the nozzle groups 20*b*. Each nozzle group 20*b* includes four supply passages 27. In this embodiment, the supply passage 27 connecting the first supply pump 22*a* to the first nozzle group 20*b*1 is a first supply passage 27*a*, the supply passage 27 connecting the second supply pump 22*b* to the second nozzle group 20*b*2 is a second supply passage 27*b*, the supply passage 27 connecting the third supply pump 22*c* to the third nozzle group 20*b*3 is a third supply passage 27*c*, and the supply passage 27 connecting the fourth supply pump 22*d* to the fourth nozzle group 20*b*4 is a fourth supply passage 27*d*.

Downstream of the supply pumps 22, the supply passages 27 are provided with respective pressure sensors 28 detecting the pressure of the passages. The values detected by the pressure sensors 28 are used to determine the abnormality of the supply pumps 22, etc. Downstream of the pressure sensors 28, the supply passages 27 are provided with respective supply pump pumping valves 29 opening and closing the passages. The supply pump pumping valves 29 are air valves controlled by a solenoid valve 29*a*. When the damping material is supplied to the supply pumps 22, the supply pump pumping valves 29 are closed to keep the pressure in the supply passages 27.

Downstream of the junctions between the supply passages 27 and the return passages 33, the supply passages 27 are provided with a temperature sensor 30 detecting the temperature of the flowing damping material, and respective pressure sensors 31 detecting the pressure of the passages. The values detected by the pressure sensors 31 are used to monitor the injection pressure of the damping material injected from the nozzle holes 20*a*, for example, to determine the clogging of the nozzle holes 20*a*. Downstream of the supply pump pumping valves 29 and upstream of the temperature sensor 30 (the pressure sensors 31), the supply passages 27 are provided with a temperature controller, which controls the temperature of the flowing damping material such that the material has a substantially constant viscosity (e.g., to 30° C.). The values detected by the temperature sensor 30 are used for feedback control of the temperatures of the temperature controller of the supply passages 27 and a temperature controller of the return passages 33, which will be descried later.

Guns 32 are provided near the nozzle groups 20*b* (i.e., the nozzle holes 20*a*) in the respective supply passages 27, that is, at the downstream ends of the supply passages 27. As shown in FIG. 6, these guns 32 are arranged in a line in the X axis direction. Adjacent two of the guns 32 are inclined to the opposite sides in the Y-axis direction. As shown in FIG. 1, the guns 32 include respective needle valves (i.e., first opening-closing valves or switch sections) (not shown) opening and closing the neighbors of the nozzle groups 20*b* in the supply passages 27. The needle valves are air valves controlled by solenoid valves 32*a*. The guns 32 can be provided near the nozzle groups 20*b* in the supply passages 27 in this manner, since the guns 32 are provided for the respective nozzle groups 20*b*. If each gun 32 is provided for one of the nozzle holes 20*a*, the same number of the guns 32 are needed, and the guns 32 cannot be provided near the nozzle holes 20*a* due to the layout. In addition, since the guns 32 are provided near the nozzle groups 20*b* in the supply passages 27, the damping material is always provided near the nozzle groups 20*b*. Furthermore, a regulator 100 controls the pressure of compressed air for turning on and off the guns 32, and valves 101 for releasing residual pressure in an air line during maintenance. As a result, the injection of the damping material from the nozzle groups 20*b* starts and ends with good responsiveness by opening and closing the needle valves.

The return passages 33 are hoses for returning the damping material to the storages 26 of the supply pumps 22, and are branched from the respective supply passages 27 downstream of the supply pump pumping valves 29 and upstream of the temperature sensor 30 (the pressure sensors 31). The return passages 33 include first to fourth upstream branch passages 33*a*-33*d* connected to the first to fourth supply passages 27*a*-27*d*, respectively, a joint passage 33*f* provided downstream of the upstream branch passages 33*a*-33*d* and jointing the passages via a manifold 33*e*, and first to fourth downstream branch passages 33*g*-33*j* provided downstream of the joint passage 33*f* and branched from the joint passage 33*f* to be connected to the storages 26 of the first to fourth supply pumps 22*a*-22*d*, respectively.

The upstream branch passages 33*a*-33*d* are provided with respective return valves 34 (i.e., second opening-closing valves or switch sections) opening and closing the passages. These return valves 34 are air valves controlled by solenoid valves 34*a*. The return valves 34 and the needle valves of the guns 32 are opened and closed by the robot controller 62 based on a robotic application program, thereby switching the supply destination of the damping material between the nozzle groups 20*b* (i.e., the nozzle holes 20*a*) and the return passages 33. Specifically, when the return valves 34 are closed and the needle valves of the guns 32 are opened, the supply destination of the damping material is switched to the nozzle groups 20*b*. As such, when the supply destination is switched to the nozzle groups 20*b*, the damping material is injected from the nozzle groups 20*b*. On the other hand, when the return valves 34 are opened and the needle valves of the guns 32 are closed, the supply destination of the damping material is switched to the return passages 33. As such, when the supply destination is switched to the return passages 33, the damping material having flowed through the return passages 33 is stored in a return pump 37. The robotic application program is set in advance in accordance with the type of the vehicle and stored in the robot controller 62, and contains information on how to apply the damping material to the floor panel P (i.e., information on applying the damping material to the floor panel P).

Downstream of the return valves 34, the upstream branch passages 33*a*-33*d* are provided with respective injection preparation pressure controllers (pressure control sections) 35 controlling the pressure in the supply passages 27. These injection preparation pressure controllers 35 are piston valves controlled by respective micro-pressure regulators 35*a*. When the damping material is not applied, the injection preparation pressure controllers 35 control the pressure in the supply passages 27 to be predetermined injection preparation pressure (e.g., about 10 MPa) so that the injection pressure of the damping material is predetermined pressure (e.g., about 8-9 MPa). This injection preparation pressure is higher than the injection pressure (i.e., the pressure in the supply passages 27 in injecting the damping material).

The joint passage 33*f* is provided with a return pump suction valve 36 opening and closing the passage. This return pump suction valve 36 is a piston valve controlled by a solenoid valve 36*a*. Downstream of the return pump suction valve 36, the joint passage 33*f* is provided with the return pump 37. This return pump 37 includes a storage 37*a* storing the damping material having flowed through the joint passage 33*f*. After the end of applying the damping material to the floor panel P, the damping material stored in the storage 37*a* is sent to the storages 26 of the supply pumps 22. The return pump 37 is an air booster pump, which has a plunger controlled by an air regulator 37*b*, an air operation valve 37*c*, and a solenoid valve 37*d*. Downstream of the return pump 37, the joint passage 33*f* is provided with a return pump pumping valve 38 opening and closing the passage. This return pump pumping valve 38 is a piston valve controlled by a solenoid valve 38*a*.

Downstream of the injection preparation pressure controllers 35 and upstream of the return pump suction valve 36, the return passages 33 is provided with the temperature controller, which controls the temperature of the flowing damping material such that the material has a substantially constant viscosity.

Downstream of the return pump pumping valve 38, the joint passage 33*f* is provided with a filter 39 collecting foreign substances contained in the flowing damping material. Downstream of the return pump pumping valve 38 and upstream of the filter 39, the joint passage 33*f* is connected to the downstream end of the supply pipe 10. Downstream of the filter 39, the joint passage 33*f* is provided with a non-return valve 40 closing the joint passage 33*f* to block backflow of the damping material.

As shown in FIG. 2, the original motor position LS 50 detects that the motor 24 is at the original position. The supply pump lower LS 51 detects that the pistons 23 of the supply pumps 22 are at the lower limit positions, that is, the storages 26 of the supply pumps 22 are empty. The upstroke deceleration LS 52 decelerates the motor 24 in the upstroke of the pistons 23 of the supply pumps 22. The return pump upper LS 53 detects that the plunger of the return pump 37 is at the upper limit position, that is, the storage 37*a* of the return pump 37 is filled up. The return pump lower LS 54 detects that the plunger of the return pump 37 is at the lower limit position, that is, the storage 37*a* of the return pump 37 is empty. The fill-up confirmation proximity SW 55 detects that the pistons 23 of the supply pumps 22 are at the upper limit position, that is, the storages 26 of the supply pumps 22 are filled up. Information indicating the on/off states of the LS 50-54 and the SW 55 are output to the stage control panel 61.

The primary material supply control panel 60 drives and controls the primary material supply system 1, and is connected to the stage control panel 61 to send and receive signals. The stage control panel 61 is connected to the robot controller 62 and the pump control panel 63 to send and receive signals, and outputs the robotic application program number corresponding to the type of the vehicle to the robot controller 62 based on vehicle type information input by an operator. Upon receipt of a pump drive trigger from the robot controller 62, the stage control panel 61 outputs the pump drive trigger to the pump control panel 63. The stage control panel 61 drives and controls the supply pump pumping valves 29, the return pump suction valve 36, the return pump 37, the return pump pumping valve 38, etc.

The robot controller 62 reads the robotic application program corresponding to the robotic application program number received from the stage control panel 61, and outputs drive instructions (drive signals) to the articulated robot 21, the needle valves of the guns 32, and the return valves 34 based on the program to drive and control the robot and the valves.

Specifically, the robot controller 62 includes three injection start instruction timers (switch sections) 64 provided for each nozzle group 20*b* to set and store injection start instruction times of outputting instructions to switch the supply destination of the damping material to the nozzle groups 20*b*, that is, injection start instructions to start injecting the damping material with the nozzle group 20*b*. The robot controller 62 further includes three injection end instruction timers (switch sections) 65 provided for each nozzle group 20*b* to set and store injection end instruction times of outputting instructions to switch the supply destination of the damping material to the return passages 33, that is, injection end instructions to end injecting the damping material with the nozzle group 20*b*. In this embodiment, the injection start instruction timers 64 provided for each nozzle group 20*b* are referred to as first to third injection start instruction timers 64*a*-64*c*. The injection end instruction timers 65 provided for each nozzle group 20*b* are referred to as first to third injection end instruction timers 65*a*-65*c*. Since three injection start instruction timers 64 and three injection end instruction timers 65 are provided for each nozzle group 20*b*, each nozzle group 20*b* independently injects the damping material.

In this embodiment, each injection start instruction timer 64 sets and stores, as an injection start instruction time $T_S$, information indicating that an injection start instruction is output in $T_S$ seconds. Each injection end instruction timer 65 sets and stores, as an injection end instruction time $T_E$, information indicating that an injection end instruction is output in $T_E$ seconds.

The robot controller 62 switches the supply destination of the damping material between the nozzle groups 20*b* and the return passages 33 based on the injection start instruction times and the injection end instruction times set and stored by the injection start instruction timers 64 and the injection end instruction timers 65 to start and end injecting the damping material.

However, the injection of the damping material cannot be started and ended immediately after the instructions are output, and the control is delayed. When the articulated robot 21 moves the nozzle device 20, the moving speed is preferably constant. However, acceleration is delayed at the initial stage of the movement, and deceleration is delayed at the terminal stage of the movement. To address the problem, the injection start instruction times and the injection end instruction times are determined in view of the delay in the control, the moving speed of the nozzle device 20, etc.

For example, assume that the nozzle device 20 moves at a high speed to reduce the time required to apply the damping material with the application apparatus. In order to start and end injecting the damping material with the nozzle groups 20*b* quickly, the injection start instruction time and the injection end instruction time corresponding to the next injection start instruction and the next injection end instruction need to be set and stored before an injection start instruction and an injection end instruction are output.

When one of the injection start instruction timers 64 is in use to output an injection start instruction, and the injection start instruction time corresponding to the next injection start instruction needs to be set and stored, another one of the injection start instruction timers 64 sets and stores the time. When one of the injection end instruction timers 65 is in use to output an injection end instruction, and the injection end instruction time corresponding to the next injection end instruction needs to be set and stored, another one of the injection end instruction timers 65 sets and stores the time.

Figure 7:
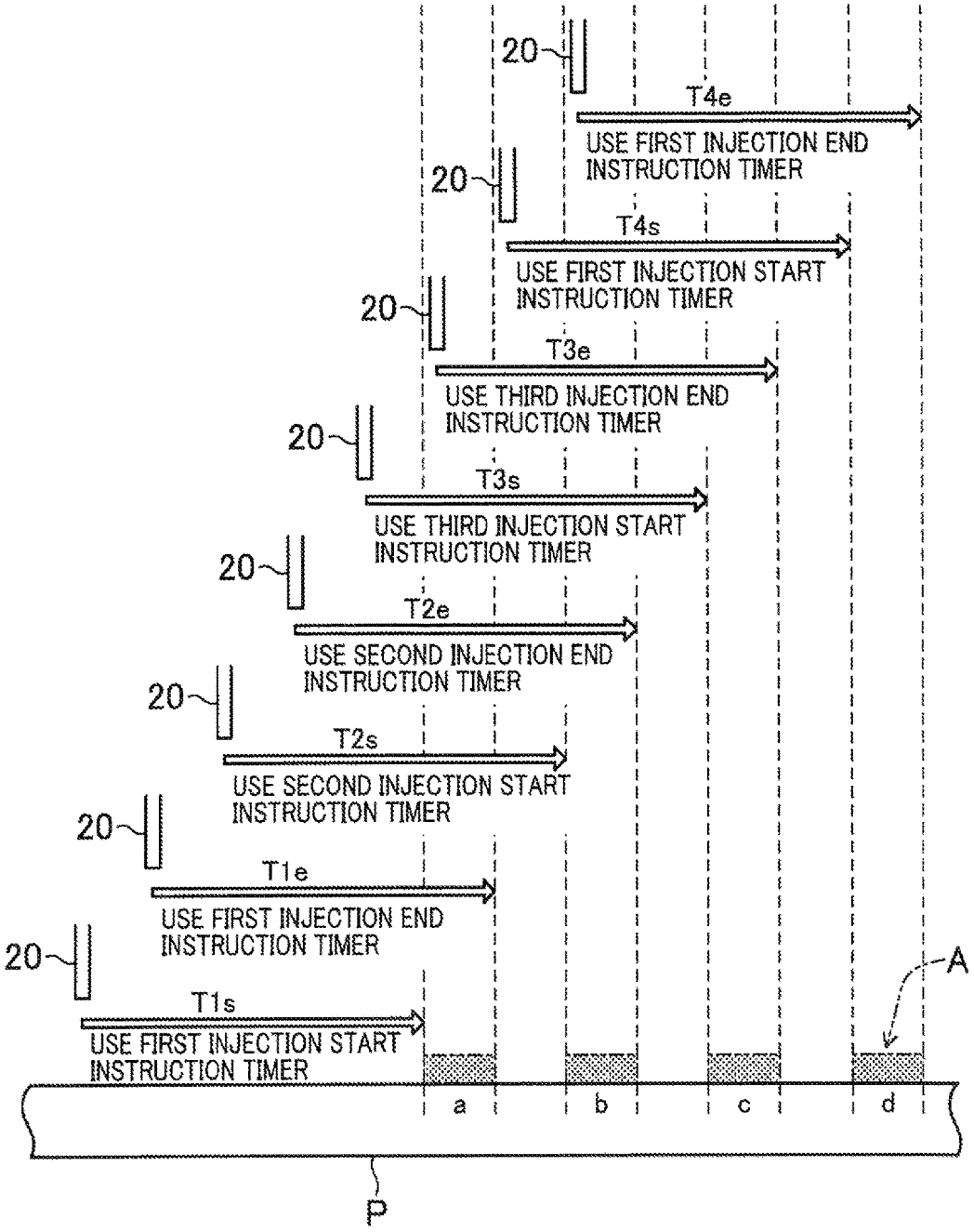
FIG. 7 is a time chart illustrating that injection start instruction timers and injection end instruction timers set injection start instruction times and injection end instruction times, respectively.

An example will be described with reference to FIG. 7. FIG. 7 is a time chart illustrating that the injection start instruction timers 64 and the injection end instruction timers 65 set and store the injection start instruction times and the injection end instruction times. In FIG. 7, the nozzle device 20 moves to the right. In FIG. 7, "a," "b," "c," and "d" represent the regions of the floor panel P to be applied with the damping material. The regions "a," "b," "c," and "d" are applied in this order, and the application length is, for example, 30 mm at minimum.

First, before the nozzle device 20 reaches the region a, the first injection start instruction timer 64*a* sets and stores an injection start instruction time $T1_S$ corresponding to the region a. Then, before the nozzle device 20 reaches the region a, the first injection end instruction timer 65*a* sets and stores an injection end instruction time $T1_E$ corresponding to the region a.

When the first injection start instruction timer 64*a* is in use to output the injection start instruction corresponding to the region a, and an injection start instruction time $T2_S$ corresponding to the region b needs to be set and stored, the second injection start instruction timer 64*b* sets and stores the time. When the first injection end instruction timer 65*a* is in use to output the injection end instruction corresponding to the region a, and an injection end instruction time $T2_E$ corresponding to the region b needs to be set and stored, the second injection end instruction timer 65*b* sets and stores the time.

When the first injection start instruction timer 64*a* is in use to output the injection start instruction corresponding to the region a, the second injection start instruction timer 64*b* is in use to output the injection start instruction corresponding to the region b, and an injection start instruction time $T3_S$ corresponding to the region c needs to be set and stored, the third injection start instruction timer 64*c* sets and stores the time. When the first injection end instruction timer 65*a* is in use to output the injection end instruction corresponding to the region a, the second injection end instruction timer 65*b* is in use to output the injection end instruction corresponding to the region b, and an injection end instruction time $T3_E$ corresponding to the region c needs to be set and stored, the third injection end instruction timer 65*c* sets and stores the time.

When an injection start instruction time $T4_S$ corresponding to the region d needs to be set and stored, the output of the injection start instruction corresponding to the region a ends, and the first injection start instruction timer 64*a* is not in use, the first injection start instruction timer 64*a* sets and stores the injection start instruction time $T4_S$ corresponding to the region d. When an injection end instruction time $T4_E$ corresponding to the region d needs to be set and stored, the output of the injection end instruction corresponding to the region a ends, and the first injection end instruction timer 65*a* is not in use, the first injection end instruction timer 65*a* sets and stores the injection end instruction time $T4_E$ corresponding to the region d.

After that, similarly, the second injection start instruction timer 64*b*, the second injection end instruction timer 65*b*, the third injection start instruction timer 64*c*, the third injection end instruction timer 65*c*, the first injection start instruction timer 64*a*, and the first injection end instruction timer 65*a* set and store the times in this order.

An example has been described with reference to FIG. 7 where the injection start instruction timers 64 and the injection end instruction timers 65 set and store the injection start instruction times and the injection end instruction times.

In reading the robotic application program, the robot controller 62 outputs the pump drive trigger to the stage control panel 61.

Upon receipt of the pump drive trigger from the stage control panel 61, the pump control panel 63 outputs pump drive instructions to the motor 24 of the supply pumps 22 to drive and control the supply pumps 22.

Control of the application apparatus using the robot controller 62, etc., will be described below.

First, control of the application operation of the application apparatus will be described with reference to the flow chart of FIG. 8. The primary suction valve 12, the supply pump pumping valves 29, the needle valves of the guns 32, the return valves 34, the return pump suction valve 36, the air operation valve 37*c* of the return pump 37, and the return pump pumping valve 38 are closed in the initial state.

Figure 8:
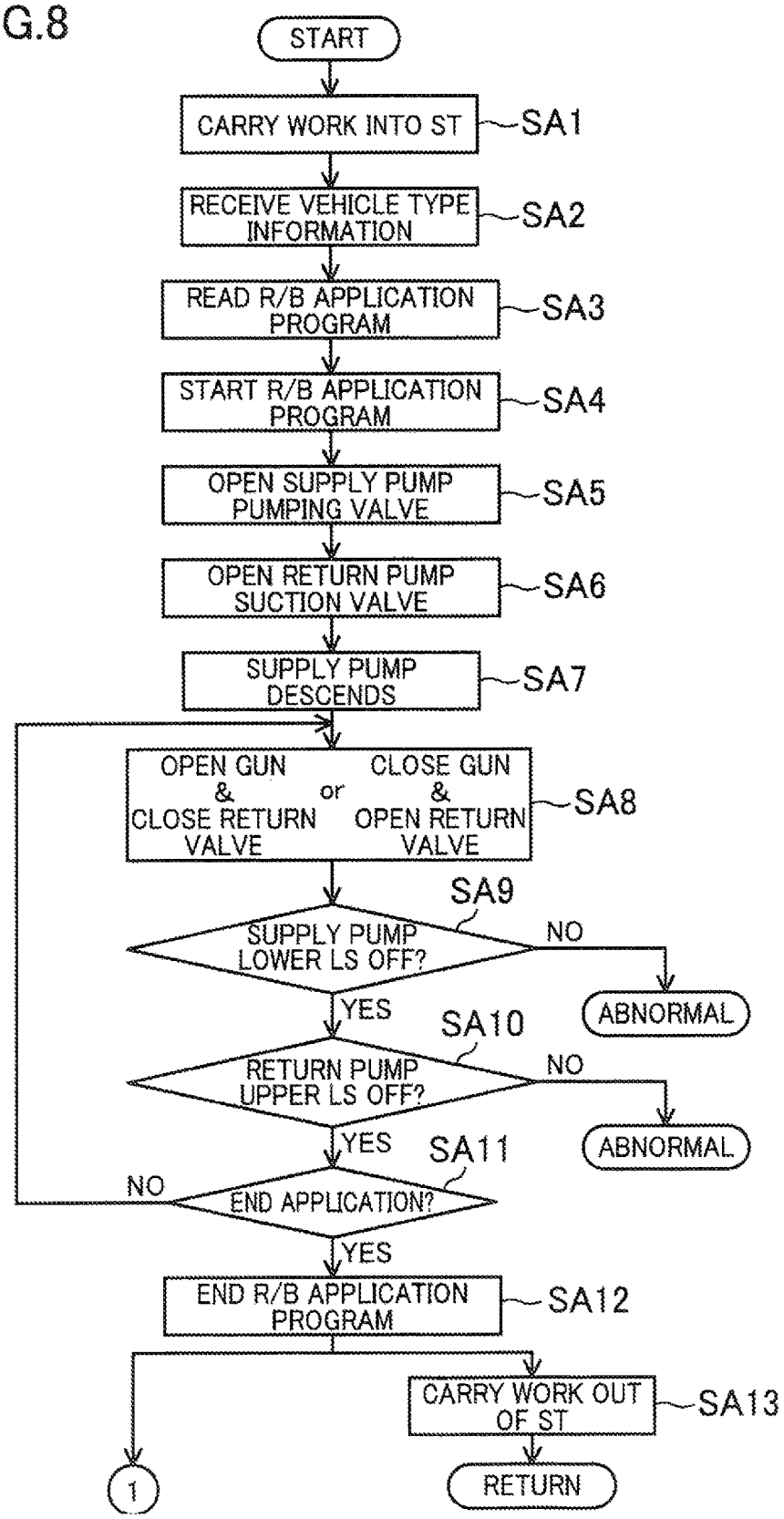
FIG. 8 is a flow chart illustrating control of the application operation of the application apparatus.

First, in step SA1, the floor panel P as a work is carried into a station (i.e., ST in FIG. 8). In the next step SA2, the stage control panel 61 receives the vehicle type information corresponding to the floor panel P. In the next step SA3, the robot controller 62 reads the robotic application program corresponding to the vehicle type information received in the step SA3. In the next step S4, the robot controller 62 starts the robotic application program (i.e., the RIB application program in FIG. 8).

In the next step SA5, the stage control panel 61 opens the supply pump pumping valves 29. In the next step SA6, the stage control panel 61 opens the return pump suction valve 36. In the next step SA7, the pump control panel 63 outputs the pump drive instructions to the motor 24 of the supply pumps so that the motor 24 allows the pistons 23 of the supply pumps 22 to continuously descend at a substantially constant speed. As a result, the damping material is continuously supplied from the storages 26 of the supply pumps 22 to the supply passages 27 in the substantially uniform amount.

In the next step SA8, the robot controller 62 controls the operation of the articulated robot 21, the needle valves of the guns 32, and the return valves 34.

Specifically, the robot controller 62 outputs a robot operation instruction to the articulated robot 21, and allows scanning movement of the nozzle device 20 attached to the wrist 21*a* relative to the surface of the floor panel P in the Y-axis direction, with the nozzle device 20 facing downward.

In scanning with the nozzle device 20, when the damping material is injected from one of the nozzle groups 20*b*, the robot controller 62 outputs an injection start instruction to the needle valve of the gun 32 and the return valve 34 corresponding to the nozzle group 20*b* to open the needle valve and to close the return valve 34. Then, the damping material is injected from the nozzle group 20*b* in the substantially uniform amount under the predetermined pressure. On the other hand, in scanning with the nozzle device 20, when the damping material is not injected from one of the nozzle groups 20*b*, the robot controller 62 outputs an injection end instruction to the needle valve of the gun 32 and the return valve 34 corresponding to the nozzle group 20*b* to close the needle valve and to open the return valve 34. At this time, the stage control panel 61 controls the injection preparation pressure controller 35 to control the pressure in the corresponding supply passage 27 to be the injection preparation pressure so that the injection pressure of the damping material from the nozzle group 20*b* becomes the predetermined pressure. Furthermore, the damping material having flowed through the return passages 33 is stored in the storage 37*a* of the return pump 37.

When one of the injection start instruction timers 64 is in use to output an injection start instruction, and the injection start instruction time corresponding to the next injection start instruction needs to be set and stored, another one of the injection start instruction timers 64 sets and stores the time. When one of the injection end instruction timers 65 is in use to output an injection end instruction, and the injection end instruction time corresponding to the next injection end instruction needs to be set and stored, another one of the injection end instruction timers 65 sets and stores the time.

In every scanning movement of the nozzle device 20 in the Y-axis direction, the nozzle device 20 moves relative to the surface of the floor panel P in the X axis direction.

In the next step SA9, the stage control panel 61 determines whether or not the supply pump lower LS 51 is off. Where the determination in the step SA9 is NO and the LS is on, the control panel determines that the storages 26 of the supply pumps 22 are empty, that is, in an abnormal state, and ends the control of the application operation. On the other hand, where the determination is YES and the LS is off, the process proceeds to step SA10.

In the step SA10, the stage control panel 61 determines whether or not the return pump upper LS 53 is off. Where the determination in the step SA10 is NO and the LS is on, the control panel determines that the storage 37*a* of the return pump 37 is filled up, that is, in an abnormal state, and ends the control of the application operation. On the other hand, where the determination is YES and the LS is off, the process proceeds to step SA11.

In the step SA11, the stage control panel 61 determines whether or not the application of the damping material to the floor panel P is ended. Where the determination in the step SA11 is NO and the application is not ended, the process returns to the step SA8. On the other hand, where the determination is YES and the application is ended, the process proceeds to step SA12.

In the step SA12, the robot controller 62 ends the robotic application program. After that, the controller outputs a material filling instruction to the stage control panel 61 to proceed to control the material filling of the application apparatus. The controller carries the floor panel P out of the station in step SA13. At the same time, the process returns to the step SA1, and the controller carries another floor panel P into the station.

Figure 9:
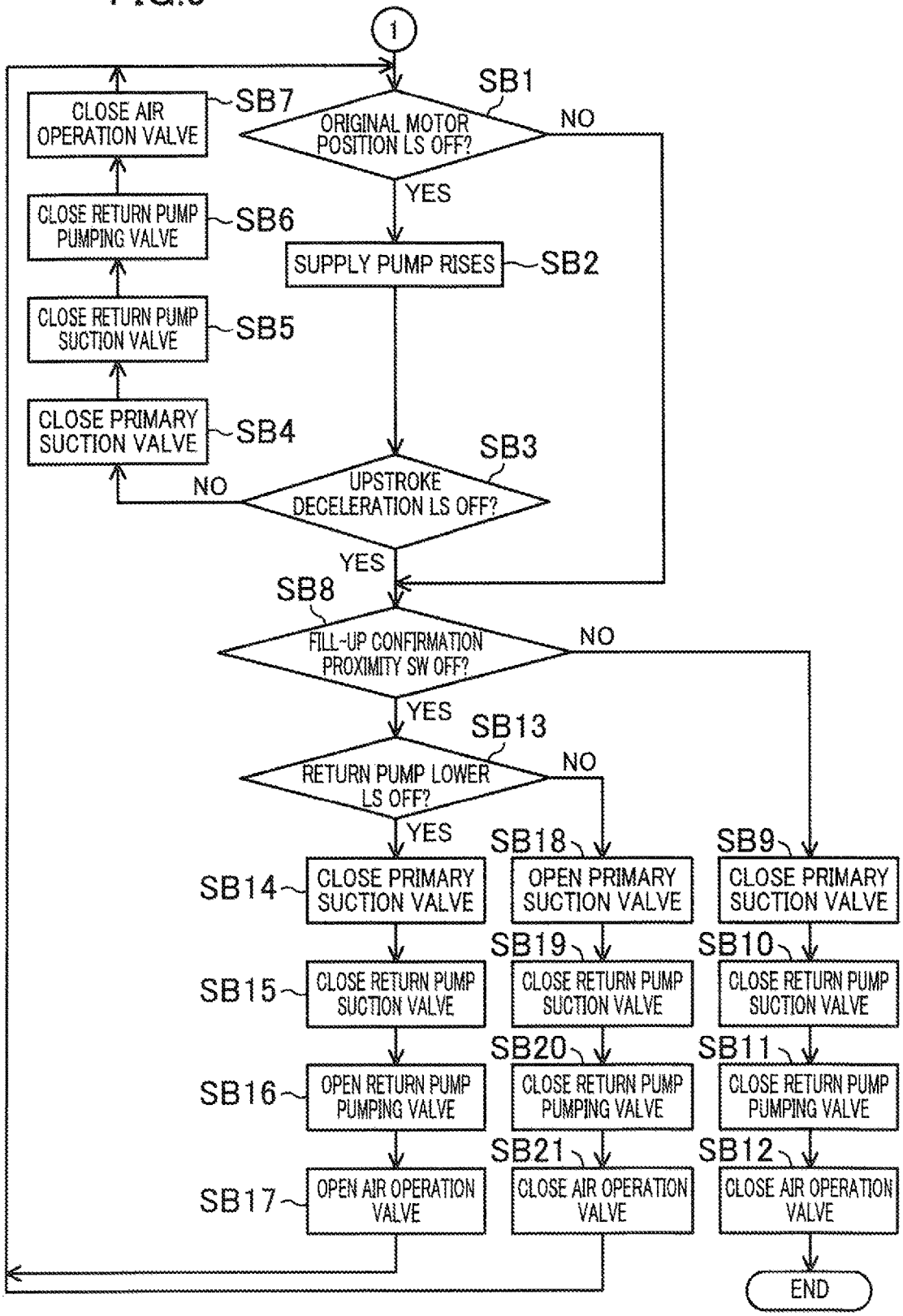
FIG. 9 is a flow chart illustrating control of the material filling operation of the application apparatus.

Next, the control of the material filling operation of the application apparatus will be described with reference to the flow chart of FIG. 9. The primary suction valve 12, the supply pump pumping valves 29, the needle valves of the guns 32, the return valves 34, the return pump suction valve 36, the air operation valve 37*c* of the return pump 37, and the return pump pumping valve 38 are closed in the initial state.

First, in step SB1, the stage control panel 61 determines whether or not the original motor position LS 50 is off. Where the determination in the step SB1 is YES and the LS is off, the process proceeds to step SB2. On the other hand, where the determination is NO and the LS is on, the control panel determines that the motor 24 is at the original position, and the process proceeds to step SB8.

In the step SB2, the pump control panel 63 outputs the pump drive instructions to the motor 24 of the supply pumps so that the motor 24 allows the pistons 23 of the supply pumps 22 to rise. In the next step SB3, the stage control panel 61 determines whether or not the upstroke deceleration LS 52 is off. Where the determination in the step SB3 is NO and the LS is on, the control panel determines that the motor 24 is a decelerated state, and the process proceeds to step SB4. On the other hand, the determination is YES and the LS is off, the control panel determines that the motor 24 is in a state other than the decelerated state, and the process proceeds to step SB8.

In the step SB4, the stage control panel 61 closes the primary suction valve 12. In the next step SB5, the stage control panel 61 closes the return pump suction valve 36. In the next step SB6, the stage control panel 61 closes the return pump pumping valve 38. In the next step SB7, the stage control panel 61 closes the air operation valve 37*c* of the return pump 37. After that, the process returns to the step SB1.

In the step SB8, the stage control panel 61 determines whether or not the fill-up confirmation proximity SW 55 is off. Where the determination in the step SB8 is NO and the SW is on, the control panel determines that the storages 26 of the supply pumps 22 are filled up, and the process proceeds to step SB9. On the other hand, the determination is YES and the SW is off, the process proceeds to step SB13.

In the step SB9, the stage control panel 61 closes the primary suction valve 12. In the next step SB10, the stage control panel 61 closes the return pump suction valve 36. In the next step SB11, the stage control panel 61 closes the return pump pumping valve 38. In the next step SB12, the stage control panel 61 closes the air operation valve 37*c* of the return pump 37. After that, the control of the material filling operation ends.

In the step SB13, the stage control panel 61 determines whether or not the return pump lower LS 54 is off. Where the determination in the step SB 13 is YES and the LS is off, the process proceeds to step SB14. On the other hand, where the determination is NO and the LS is on, the control panels determines that the storage 37*a* of the return pump 37 is empty, and the process proceeds to step SB18.

In the step SB14, the stage control panel 61 closes the primary suction valve 12. In the next step SB15, the stage control panel 61 closes the return pump suction valve 36. As such, the return pump suction valve 36 is closed to prevent the damping material from flowing back to the injection preparation pressure controllers 35. In the next step SB16, the stage control panel 61 opens the return pump pumping valve 38. In the next step SB17, the stage control panel 61 opens the air operation valve 37*c* of the return pump 37. Then, the plunger of the return pump 37 descends to refill the storages 26 of the supply pumps 22 with the damping material from the storage 37*a* of the return pump 37 to via the return passages 33. After that, the process returns to the step SB1.

In the step SB18, the stage control panel 61 opens the primary suction valve 12. Then, the damping material refills the storages 26 of the supply pumps 22 from the tank of the primary material supply system 1 via the supply pipe 10. In the next step SB19, the stage control panel 61 closes the return pump suction valve 36. In the next step SB20, the stage control panel 61 closes the return pump pumping valve 38. In the next step SB21, the stage control panel 61 closes the air operation valve 37*c* of the return pump 37. After that, the process returns to the step SB1.

Advantages

As described above, according to this embodiment, the supply pumps 22 are continuously driven to continuously supply the damping material from the supply pumps 22 to the supply passages 27 in the substantially uniform amount. Based on the information on applying the damping material to the floor panel P, the supply destination of the damping material is switched between the nozzle holes 20*a* and the return passages 33. As such, the supply pumps 22 are continuously driven. As compared to the case where the supply pumps 22 are intermittently driven, response delays are reduced in supplying the damping material to the nozzle holes 20*a* at the start of injecting the damping material from the nozzle holes 20*a*. The damping material is injected from the nozzle holes 20*a* with good responsiveness. Therefore, the damping material is stably injected.

The guns 32 opening and closing the supply passages 27 are provided downstream of the junctions between the supply passages 27 and the return passages 33. The return valves 34 opening and closing the return passages 33 are provided in the return passages 33. The needle valves of the guns 32 and the return valves 34 are opened and closed to switch the supply destination of the damping material between the nozzle holes 20*a* and the return passages 33. As a result, the supply destination of the damping material is switched between the nozzle holes 20*a* and the return passages 33 with the simple structure.

The injection preparation pressure controllers 35 controlling the pressure in the supply passages 27 are provided downstream of the return valves 34 in the return passages 33. As a result, the pressure in the supply passages 27 is controlled to be the predetermined pressure.

If the guns 32 are provided far from the nozzle holes 20*a* in the supply passages 27, the flow of the damping material between the needle valves and the nozzle holes 20*a* in the supply passages 27 does not stop immediately after closing the needle valves. The damping material may spray out of the nozzle holes 20*a* at the end of the injection.

In this embodiment, the guns 32 are provided near the nozzle holes 20*a* in the supply passages 27 to minimize the amount of the damping material flowing between the needle valves and the nozzle holes 20*a* in the supply passages 27. This prevents the damping material from spraying out of the nozzle holes 20*a* at the end of the injection. Therefore, the damping material is applied more stably.

The return pump 37, which includes the storage 37*a* storing the damping material having flowed through the return passages 33, is provided in one of the return passages 33. This reduces changes in the characteristics (e.g., curing) of the damping material caused by contact with the air. After the end of applying the damping material to the floor panel P, the return pump 37 sends the damping material stored in the storage 37*a* to the supply pumps 22, thereby stably refilling the supply pumps 22 with the damping material.

The temperature controllers, which control the temperature of the damping material such that the material has the substantially constant viscosity, are provided for the supply passages 27 and the return passages 33. As a result, the viscosity of the damping material is controlled to be substantially constant.

The supply pumps 22 are cylinder pumps driven by the same single motor 24. As compared to the case where the supply pumps 22 are driven by different drive sections, the damping material is stably continuously supplied from the supply pumps 22 to the supply passages 27 in the substantially uniform amount.

The injection start instruction timers 64 setting the injection start instruction times of outputting the injection start instructions to switch the supply destination of the damping material to the nozzle holes 20*a*, and the injection end instruction timers 65 setting the injection end instruction times of outputting the injection end instructions to switch the supply destination of the damping material to the return passages 33 are provided for the respective nozzle groups 20*b*. As a result, each nozzle group 20*b* independently injects the damping material from the via the nozzle holes 20*a*.

When one of the injection start instruction timers 64 is in use to output an injection start instruction, another one of the injection start instruction timers 64 sets the injection start instruction time corresponding to the next injection start instruction. When one of the injection end instruction timers 65 is in use to output an injection end instruction, another one of the injection end instruction timers 65 sets the injection end instruction time corresponding to the next injection end instruction. As a result, failures in outputting the next injection start instruction and the next injection end instruction are reduced. As a result, the damping material is applied more stably.

Since the moving section is the articulated robot 21, the movement of the joints reliably moves the nozzle device 20 relative to the floor panel P.

Other Embodiments

While in the above-described embodiment, the damping material is applied, the applied material is not limited thereto and may be cohesive materials other than the damping material.

While in the above-described embodiment, the damping material is applied to the floor panel P, the application target is not limited thereto and may be, for example, a part of the vehicle body other than the floor panel P.

While in the above-described embodiment, the seven nozzle holes 20*a* are provided in each nozzle group (i.e., nozzle section) 20*b*, the number is not limited thereto and may be 1-6, 8, or more depending on the width of the application regions A.

While in the above-described embodiment, the four nozzle groups 20*b* are provided, the number is not limited thereto and may be 1-3, 5, or more. In this case, the supply pumps 22, the supply passages 27, the guns 32, the upstream branch passages and the downstream branch passages of the return passages 33, etc., are provided in the same number as the nozzle groups 20*b*.

In the above-described embodiment, the injection preparation pressure controllers 35 are provided downstream of the return valves 34 in the upstream branch passages 33*a*-33*d*. Instead, contractions (i.e., pressure control sections) may be provided to control the pressure in the supply passages 27. In this case, even when the temperature of the damping material changes, the difference in the pressure in the supply passages 27 between the injection time and the non-injection time of the damping material is kept constant.

While in the above-described embodiment, the three injection start instruction timers 64 and the three injection end instruction timers 65 are provided, the number is not limited thereto and may be, for example, two, four, or more. The numbers of the injection start instruction timers 64 and the injection end instruction timers 65 may be increased in moving the nozzle device 20 more quickly, or in starting and ending the injection of the damping material with the nozzle groups 20*b* more quickly.

The present invention is not limited to the embodiment. Various modifications and variations may be made without departing from the spirit and scope of the present invention.

In all respects, the above-described embodiment is illustrative only and is not to be construed as limiting the scope of the present invention. The scope of the present invention is measured by the claims and not by the specification. It is intended by the following claims to claim any and all modifications and variations that fall within the true scope of the advantageous concepts disclosed herein.

INDUSTRIAL APPLICABILITY

As described above, the application apparatus according to the present invention is useful for situations requiring stable application of a damping material.

DESCRIPTION OF REFERENCE CHARACTERS (20) Nozzle Device
(20*a*) Nozzle Hole
(20*b*) Nozzle Group (Nozzle Section)
(21) Robot (Moving Section)
(22) Supply Pump
(24) Motor (Drive Section)
(27) Supply Passage
(32) Gun (First Opening-Closing Valve)
(33) Return Passage
(34) Return Valve (Second Opening-Closing Valve)
(35) Injection Preparation Pressure Controller (Pressure Control Section)
(37) Return Pump
(37*a*) Storage
(62) Robot Controller (Switch Section)
(64) Injection Start Instruction Timer (Switch Section)
(65) Injection End Instruction Timer (Switch Section)
(A) Application Region
(P) Floor Panel

The invention claimed is:

1. An application apparatus applying a cohesive material to an application target, the apparatus comprising:

a nozzle device configured to inject the cohesive material from a nozzle to the application target;

a moving section configured to move the nozzle device relative to the application target;

a supply section including a supply pump for sending the cohesive material to the nozzle and a supply passage for supplying the cohesive material from the supply pump to the nozzle, and configured to cause a drive section to continuously drive the supply pump to continuously supply the cohesive material from the supply pump to the supply passage in a substantially uniform amount;

a return passage branched from the supply passage and configured to return the cohesive material to the supply pump;

a switch section configured to switch a supply destination of the cohesive material between the nozzle and the return passage based on information on applying the cohesive material to the application target; and a return pump, being an air booster pump, provided in the return passage, including a storage, provided in the return pump, storing the cohesive material having flowed through the return passage, and configured to send the cohesive material stored in the storage to the supply pump after the cohesive material is applied to the application target, the return pump being separate from the supply pump.

2. The application apparatus of claim 1, wherein the switch section includes a first opening-closing valve provided downstream of a junction between the supply passage and the return passage, and opening and closing the supply passage, and a second opening-closing valve provided in the return passage, and opening and closing the return passage, and the switch section switches the supply destination of the cohesive material between the nozzle and the return passage by opening and closing the first and second opening-closing valves.

3. The application apparatus of claim 2, further comprising:

a pressure control section provided downstream of the second opening-closing valve in the return passage, and configured to control pressure in the supply passage.

4. The application apparatus of claim 2, wherein the first opening-closing valve is provided at a downstream end of the supply passage.

5. The application apparatus of claim 1, further comprising:

a temperature controller configured to control a temperature of the cohesive material such that the cohesive material has a substantially constant viscosity.

6. The application apparatus of claim 1, wherein the nozzle includes a single nozzle or a plurality of nozzles, the nozzle device includes a plurality of nozzle sections each including the single nozzle or the plurality of nozzles, the cohesive material injected from each of the nozzle sections forms an application region with a predetermined width on the application target, the supply pump is provided for each of the nozzle sections to send the cohesive material to a corresponding one of the nozzle sections, the supply passage is provided for each of the nozzle sections to supply the cohesive material from a corresponding one of the supply pumps to a corresponding one of the nozzle sections, and the return passage is branched from each of the supply passages to return the cohesive material to the supply pumps.

7. The application apparatus of claim 6, wherein the nozzle sections are arranged in a line in a predetermined direction.

8. The application apparatus of claim 6, wherein the supply pumps are cylinder pumps driven by a same single drive section.

9. The application apparatus of claim 6, wherein the switch section includes an injection start instruction timer provided for each of the nozzle sections, and setting an injection start instruction time of outputting an injection start instruction to switch the supply destination of the cohesive material to the nozzle, and an injection end instruction timer provided for each of the nozzle sections, and setting an injection end instruction time of outputting an injection end instruction to switch the supply destination of the cohesive material to the return passage, and the switch section switches the supply destination of the cohesive material between the nozzle and the return passage based on the injection start instruction time and the injection end instruction time set by the injection start instruction timer and the injection end instruction timer.

10. The application apparatus of claim 1, wherein the switch section includes a plurality of injection start instruction timers each of which sets an injection start instruction time of outputting an injection start instruction to switch the supply destination of the cohesive material to the nozzle, and a plurality of injection end instruction timers each of which sets an injection end instruction time of outputting an injection end instruction to switch the supply destination of the cohesive material to the return passage, the switch section switches the supply destination of the cohesive material between the nozzle and the return passage based on the injection start instruction time and the injection end instruction time set by each of the injection start instruction timers and the injection end instruction timers, when one of the injection start instruction timers is in use to output a corresponding one of the injection start instructions, the switch section allows another one of the injection start instruction timers to set one of the injection start instruction times corresponding to next one of the injection start instructions, and when one of the injection end instruction timers is in use to output a corresponding one of the injection end instructions, the switch section allows another one of the injection end instruction timers to set one of the injection end instruction times corresponding to next one of the injection end instructions.

11. The application apparatus of claim 1, wherein the moving section is an articulated robot, and movement of joints of the articulated robot moves the nozzle device relative to the application target.

* * * * *